US005913474A

United States Patent [19]

Chu

[11] Patent Number: 5,913,474

[45] Date of Patent: Jun. 22, 1999

[54] FOLDABLE TOTE BOX

[75] Inventor: Lawrence H. Y. Chu, Coppell, Tex.

[73] Assignee: Merryland Products, Inc., Grand Prairie, Tex.

[21] Appl. No.: 08/949,174

[22] Filed: Oct. 10, 1997

[51] Int. Cl.[6] ..... B65D 5/22

[52] U.S. Cl. ..... 229/167; 229/178; 229/198.2; 229/915; 229/919

[58] Field of Search ..... 229/178, 191, 229/167, 195, 197, 198.2, 915, 918, 919

[56] References Cited

U.S. PATENT DOCUMENTS

| | | | |
|---|---|---|---|
| 374,886 | 12/1887 | Brown | 229/195 |
| 2,465,324 | 3/1949 | DeMian . | |
| 2,544,283 | 3/1951 | Snyder . | |
| 2,572,239 | 10/1951 | Burgstein . | |
| 2,893,621 | 7/1959 | Harnish et al. . | |
| 2,954,914 | 10/1960 | Herlihy | 229/178 |
| 2,986,320 | 5/1961 | Nichols et al. . | |
| 3,003,676 | 10/1961 | De Nola . | |
| 3,012,703 | 12/1961 | Gander . | |
| 3,114,493 | 12/1963 | Dunkin . | |
| 3,184,136 | 5/1965 | Forbs, Jr. . | |
| 3,196,021 | 7/1965 | Oas et al. . | |
| 3,228,008 | 1/1966 | Chiorri . | |
| 3,310,219 | 3/1967 | Dlugopolski | 229/178 |
| 3,375,967 | 4/1968 | Robinson . | |
| 3,410,475 | 11/1968 | Wagner . | |
| 3,682,369 | 8/1972 | Isakson . | |
| 3,687,354 | 8/1972 | Jeanings . | |
| 3,708,103 | 1/1973 | Evans . | |
| 3,734,392 | 5/1973 | Clark . | |
| 3,738,562 | 6/1973 | Schwartz . | |
| 3,820,706 | 6/1974 | Gibson et al. . | |
| 3,883,067 | 5/1975 | McGlynn et al. . | |
| 3,940,053 | 2/1976 | Putman et al. . | |
| 3,991,932 | 11/1976 | Carren et al. . | |
| 4,053,098 | 10/1977 | Baptist . | |
| 4,055,293 | 10/1977 | Stramaglia . | |
| 4,068,795 | 1/1978 | Forster . | |
| 4,129,247 | 12/1978 | McCall . | |
| 4,142,665 | 3/1979 | Jewell et al. . | |
| 4,175,691 | 11/1979 | Cornell et al. . | |
| 4,236,740 | 12/1980 | Sorenson et al. . | |
| 4,279,377 | 7/1981 | Peeples . | |
| 4,373,659 | 2/1983 | Cornell et al. . | |
| 4,418,863 | 12/1983 | Kimbrell, Sr. | 229/918 X |
| 4,463,997 | 8/1984 | Densen | 229/198.2 |

(List continued on next page.)

FOREIGN PATENT DOCUMENTS

| | | | |
|---|---|---|---|
| 101467 | 7/1965 | Denmark | 229/167 |
| 1202224 | 1/1960 | France | 229/167 |
| 2834418 | 2/1980 | Germany | 229/918 |
| 640355 | 5/1962 | Italy | 229/167 |

*Primary Examiner*—Gary E. Elkins
*Attorney, Agent, or Firm*—Jie Sha

[57] ABSTRACT

A foldable tote box is formed by a one-pierce die-cut and scored board of corrugated material, especially corrugated plastic materials. The board includes a rectangular bottom panel having a length and a width defined by pairs of side and end edges. Each of a pair of sidewall panels has a folding edge integrally connected to the side edge of the bottom panel along a first scored folding line, a top edge and a pair of end edges that define a height of the box. Each pair of two filler beam panels are integrally connected to the end edges of one of the sidewall panels along second scored folding lines. Each filler beam panel is folded to form a hollow support beam. A pair of end wall panels are integrally connected to the end edges of the bottom panel along third scored folding lines. Each end wall panel includes an end wall section and a flap section divided by double scoring lines, thereby defining a support surface between the double scoring lines. Locking members include locking pieces and holes on the end wall panels and latch openings and tongues on the sidewall panels to lock the flap sections to the sidewall panels such that the flap section of each end wall panel holds two support beams formed against the end wall section of the end wall panel.

15 Claims, 7 Drawing Sheets

U.S. PATENT DOCUMENTS

| | | | |
|---|---|---|---|
| 4,733,916 | 3/1988 | Seufert | 229/162 |
| 4,770,338 | 9/1988 | Tatusch | 229/102 |
| 4,770,339 | 9/1988 | Weimer | 229/143 |
| 4,883,221 | 11/1989 | Brundage | 229/143 |
| 5,002,224 | 3/1991 | Muise | 229/169 |
| 5,020,674 | 6/1991 | Thorud et al. | 229/918 X |
| 5,125,568 | 6/1992 | Bauer | 229/172 |
| 5,402,932 | 4/1995 | Fadaie | 229/195 |
| 5,452,848 | 9/1995 | Mur Glmeno | 229/191 |
| 5,501,395 | 3/1996 | MeElroy | 229/148 |
| 5,535,941 | 71996 | Garza | 229/918 X |

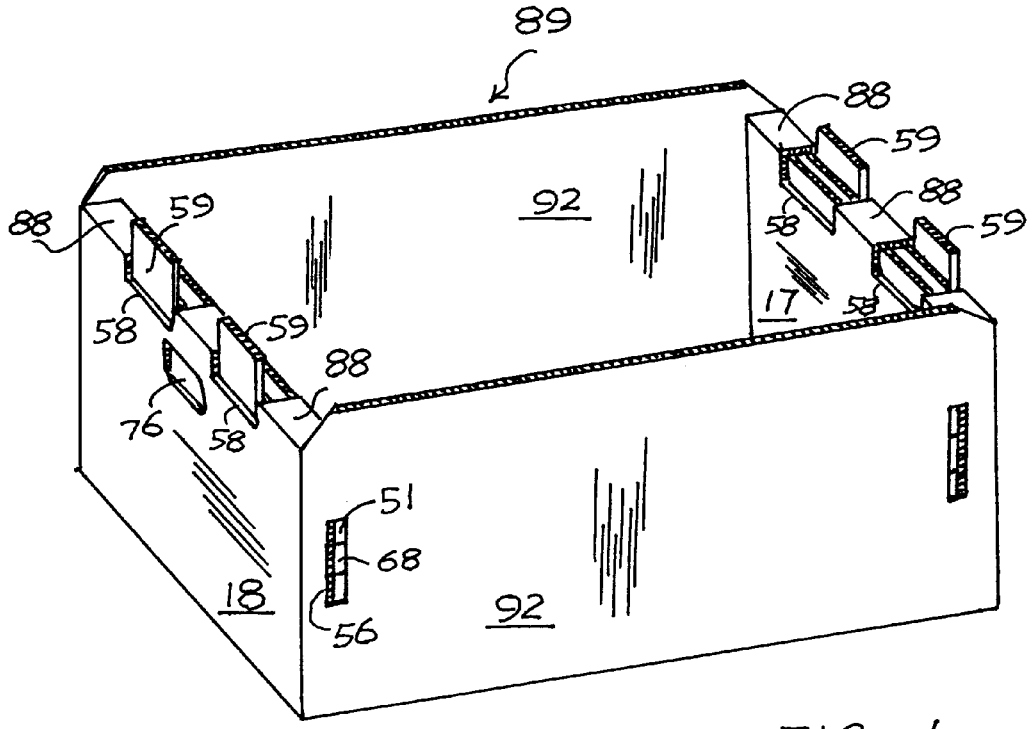
FIG 1
FIG 12
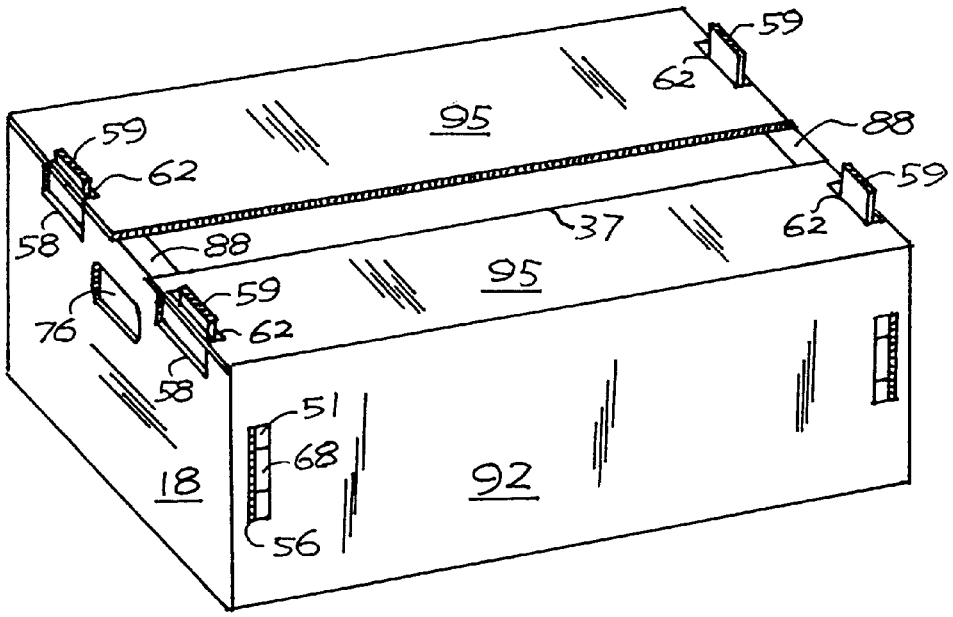

FIG 3
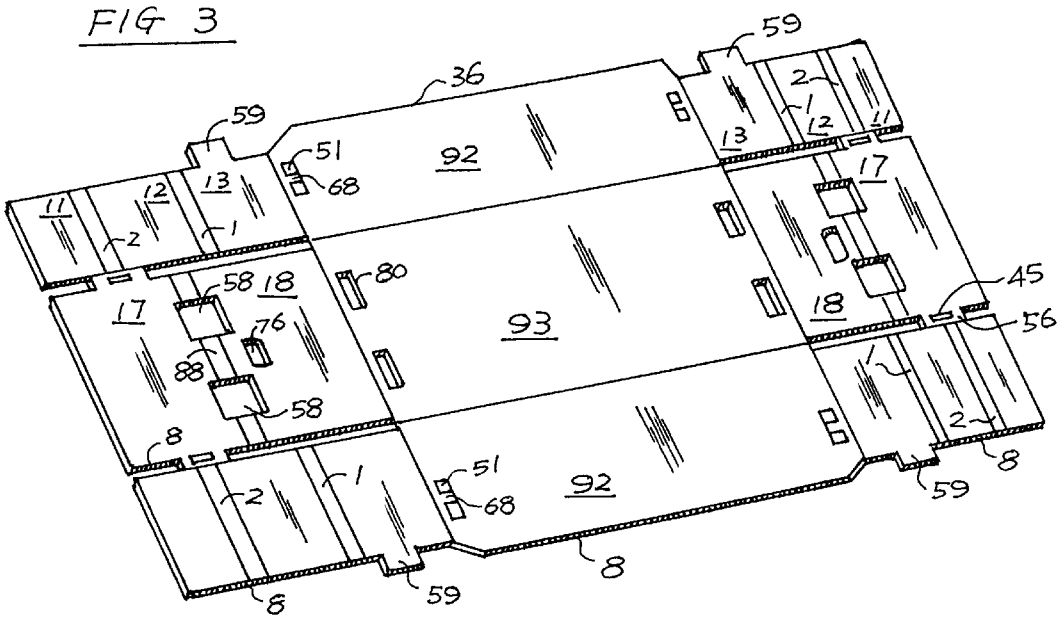
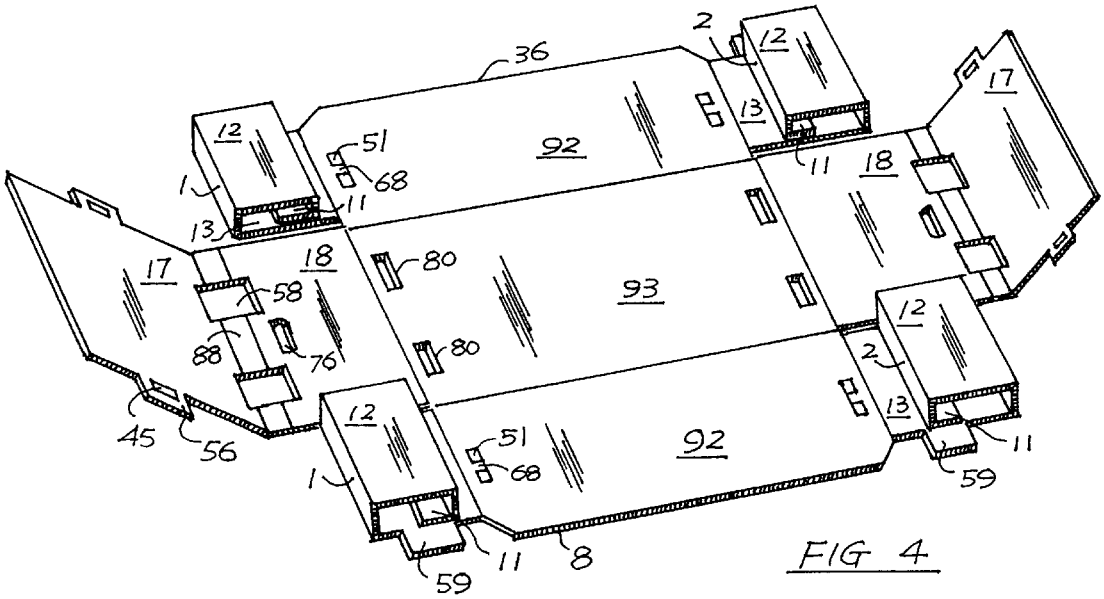
FIG 4

FIG 5
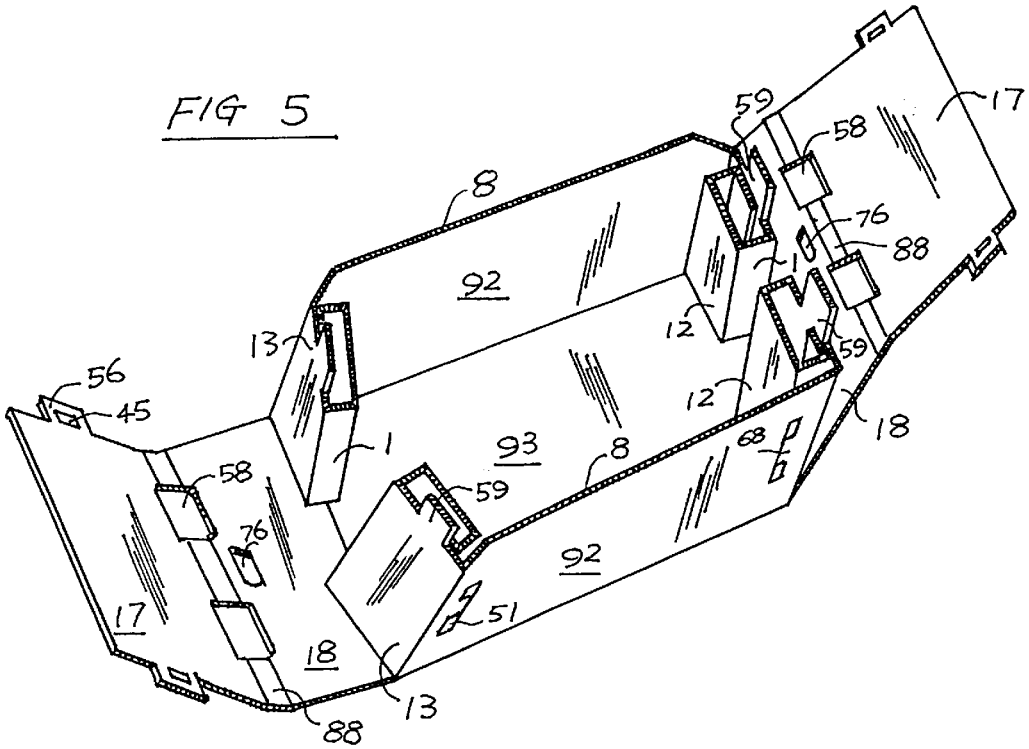
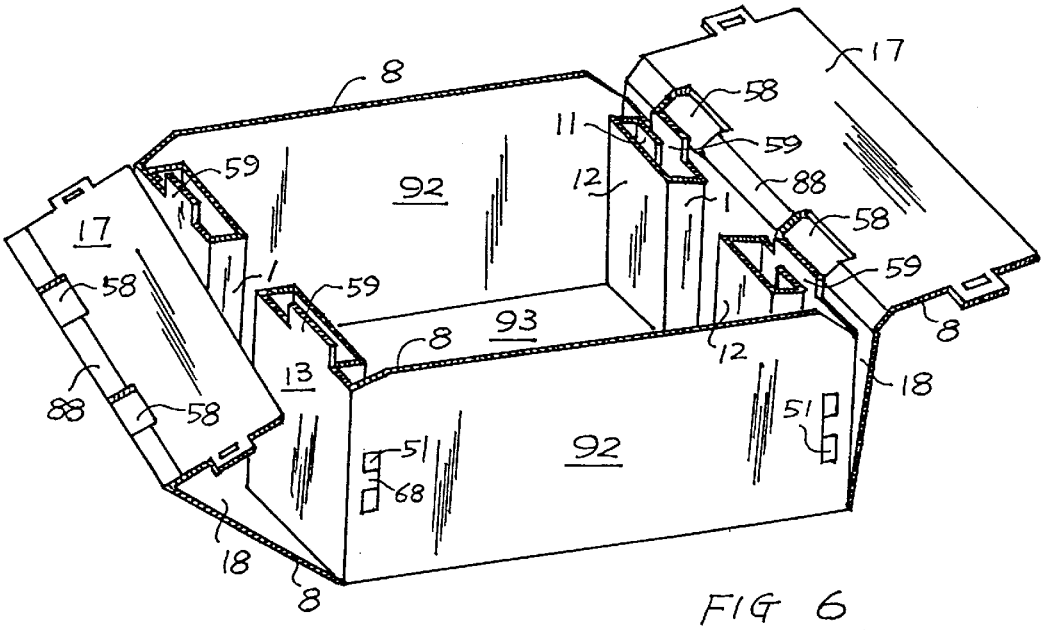
FIG 6

31
32
33
34
35
37
45
56
59
60
61
62
26
27
28
92
95

FOLDABLE TOTE BOX

FIELD OF THE INVENTION

The present invention relates to a foldable box or tote box, particularly to a tote box for holding general merchandise and fresh produce. More particularly, the tote box of the present invention is formed of a one-piece board of corrugated materials, especially corrugated plastic materials. The tote box of this invention is designed to be used not only outdoor, such as in the farmland under sunshine, raining, or even snowing weather conditions, but also indoor, such as cold storage or refrigerated transportation of goods, especially fresh produce that should be kept in special environment to preserve their quality.

BACKGROUND OF THE INVENTION

There are many kinds of boxes or cartons known in the art, that are used for holding goods for storage and transportation. These known boxes are made of various materials, such as cardboard, wood, metal, and plastics. However, all of the known boxes have, respectively, various disadvantages, such as moisture immersion, high cost, non-foldability, or too heavy. Particularly, none of the known foldable boxes is suitable for all environmental conditions, such as sunshine or hot environment, wet or humid conditions, cold or frozen conditions, and stacking-up with heavy load. Therefore, there is a need or demand for a durable box which can be used in any kinds of environment in which a box would be used. At the same time, the box must be cost efficient or economical, easily foldable, easily transportable, reusable, light weight, moisture resistant or moisture free, washable, and capable of stacking-up to bear heavy load for a relatively long period of time. The box should also be recyclable.

At present, no single box can meet all of these requirements. Most of one-piece board of foldable boxes are made of cardboard, waxed cardboard, or thin plastics because thick plastic boards cannot so easily folded. Such boxes usually utilize laminate layers or fillers to reinforce the side and end walls or corners of the box for better support. However, the support surfaces or tops are limited, i.e., relatively narrow. Therefore, the support is not strong enough to provide stable support for stacking-up boxes that are heavily loaded for a relatively longer time. Under certain bad environments, the multi-layers or fillers that stand side-by-side can be easily softened or weakened by the direct and strong sunshine or moisture. Such boxes are disclosed, for instance, in U.S. Pat. No. 4,129,247 to McCall; U.S. Pat. No. 4,068,795 to Forster; U.S. Pat. No. 2,465,324 to De Mian; U.S. Pat. No. 4,770,338 to Tatusch; and U.S. Pat. No. 4,279,377 to Peeples et al.

The normal locking system for the boxes are tab and slot engagements that are not deadly locked. For example, the inset tabs and the slots are used in U.S. Pat. No. 4,733,916 to Seufert; and U.S. Pat. No. 3,708,103 to Evants. The barbed tabs are used in U.S. Pat. No. 3,991,932 to Carmel et al. Such locks can be easily released or unlocked without notice. Most of these locks are designed for cardboard material which is relatively soft and flexible. Thus, the locks cannot hold the box panels together once the material of the box looses its strength because of moisture immersion or merely worn-out.

SUMMARY OF THE INVENTION

In accordance with the present invention, a foldable tote box comprises a one-pierce die-cut board of corrugated material, said board including a rectangular bottom panel having a predetermined length and width defined by pairs of side and end edges; a pair of sidewall panels, each having a folding edge integrally connected to the side edge of the bottom panel along a first scored folding line, a top edge opposite to the folding edge, and a pair of end edges defining a predetermined height of the box; two pairs of filler beam panels, each pair of the filler beam panels respectively integrally connected to and extended from said end edges said respective pair of sidewall panels along second scored folding lines, each of said filler beam panels being folded to form a hollow support beam; a pair of end wall panels respectively integrally connected to and extended from the end edges of the bottom panel along third scored folding lines, each of said end wall panels including a flap section and an end wall section divided by double scoring lines, thereby defining a support surface between the double scoring lines; and integrally formed means for locking the flap section to one of the bottom panel and sidewall panels such that the flap section of each end wall panel holds two support beams formed by said filler beam panels against the end wall section of the end wall panel.

Each of said filler beam panels includes at least three sections proportionally divided by double scoring lines between adjacent sections. A stacking tab is integrally formed at a top edge of the filler beam panel and positioned at one of the three sections. There are two notch openings at predetermined locations along the scoring lines so that each tab of the filler beam panel protrudes through each of the notch openings when the board is folded to form the box. Preferably, the stacking tab is positioned at the innermost section of the filler beam panel close to the second scored folding lines. Upon stacking, the stacking tabs of the lower box will restrict the movement of the upper box at least in the directions perpendicular to the end wall section of the box.

A pair of latch openings are formed respectively adjacent to the end edges of the sidewall panel. Each latch opening has a latch tongue formed therein. There are a pair of locking holes formed in a pair of lock pieces that are respectively extended from side edges of each end wall panel at the flap section such that each locking hole engages each latch tongue on the respective sidewall panel to lock the box being assembled. These latching and locking members constitute the locking system of this invention.

Further, a longitudinal protrusion extends outwardly along the top edge of each sidewall panel opposite to the folding edge. The protrusions will restrict the movement of the upper box in the directions perpendicular to the sidewall panels of the box upon stacking of the boxes. Still further, there are stacking holes formed in the bottom panel of the box. Usually, two staking roles are provided adjacent to the end edge of the bottom panel of the box. Thus, the staking tabs of the lower box will engage with the stacking holes of the upper box to lock the upper box in position, i.e., restricting the movement of the upper box in all directions. In this situation, the sidewall protrusion may not be needed.

Furthermore, a cover panel or a pair of cover panels can be integrally formed to and extended from the top edge of the sidewall panel or panels along a fourth scored folding line. Thus, the cover or cover panels may rest on the support surfaces of the end wall panels to cover the top opening of the box, while the protrusions are eliminated. However, thanks to the stacking tabs and holes, the stacking holes of the upper box will engage the stacking tabs of the lower box. Therefore, the stacking-up boxes can still be restricted from movement in all directions. The present invention can be well understood in the following descriptions in connection with the accompanying drawings.

BRIEF DESCRIPTION OF DRAWINGS

FIG. 1 is a perspective view of a tote box of the present invention;

FIGS. 3–6 are perspective views showing the assembling process of the box including the formation of support beams by the filler beam flaps and the support surfaces by the end walls of the tote box of the present invention;

FIG. 12 is a perspective view of the tote box with the top cover of the present invention.

DETAILED DESCRIPTION OF THE INVENTION

Figure 10:
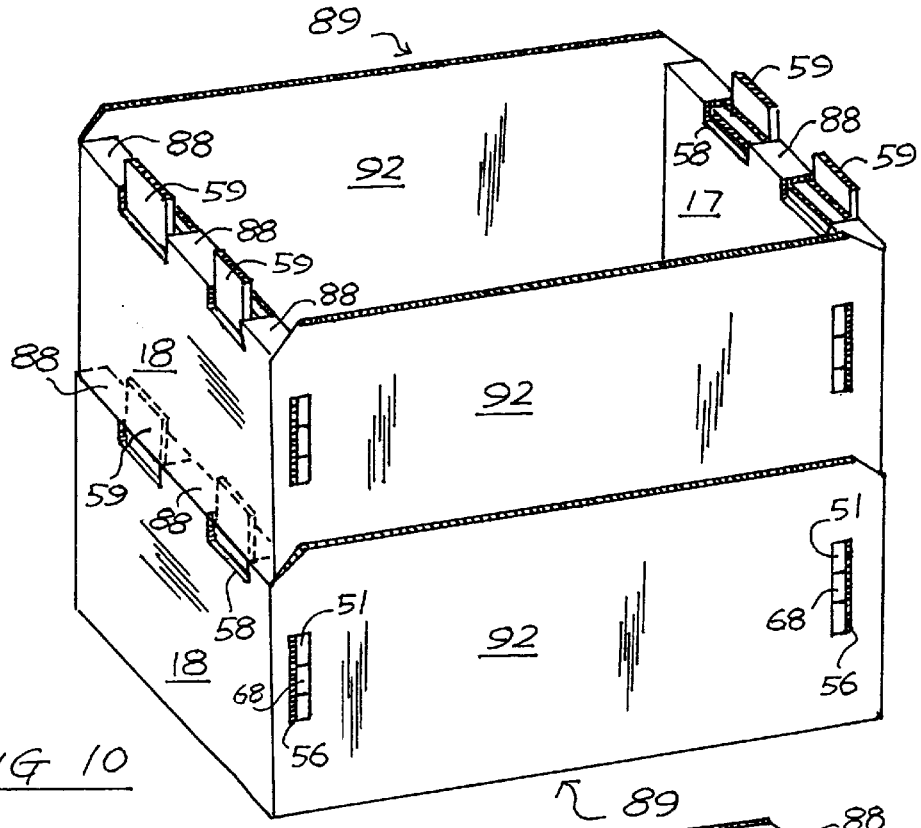
FIGS. 10 and 10A are perspective views of the assembled tote boxes, that are stacked one on top of the other.
Figure 10A:
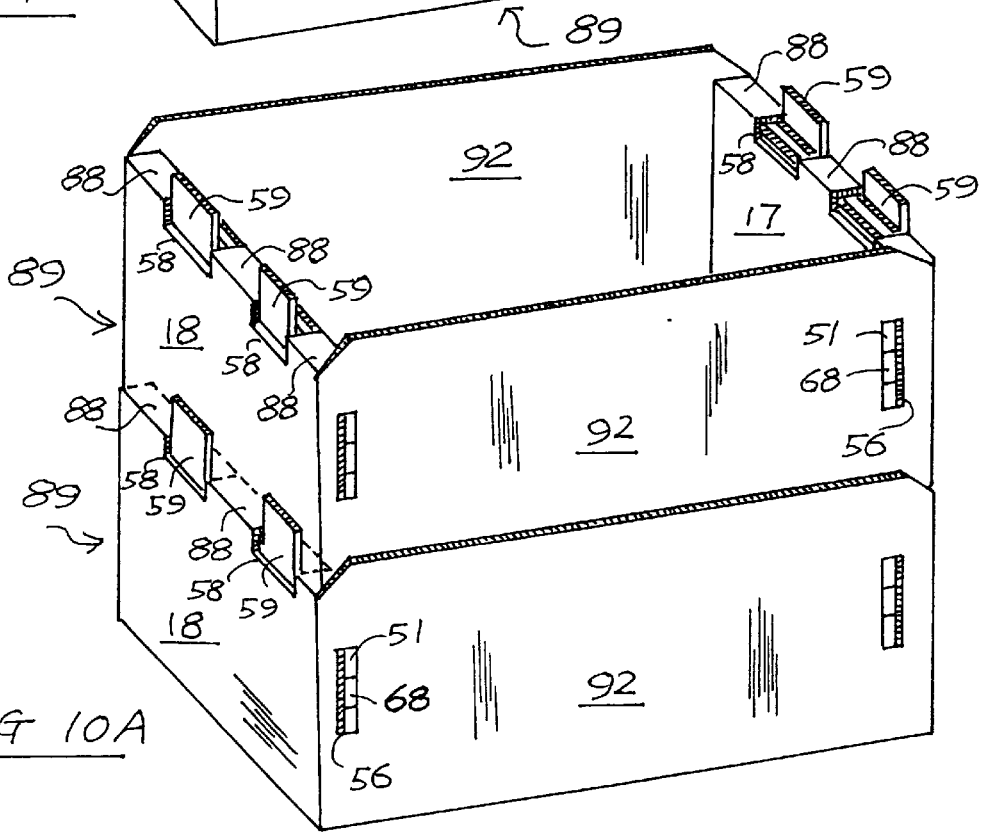

The tote box 89 of the present invention is generally illustrated in FIG. 1. The box 89 includes a bottom, two sidewalls and two end walls. Four upright tabs 59, notches or notch openings 58, and support surfaces 88 will give the novel tote box of the present invention a completely new way of stacking as shown in FIGS. 10 and 10A.

Figure 2:
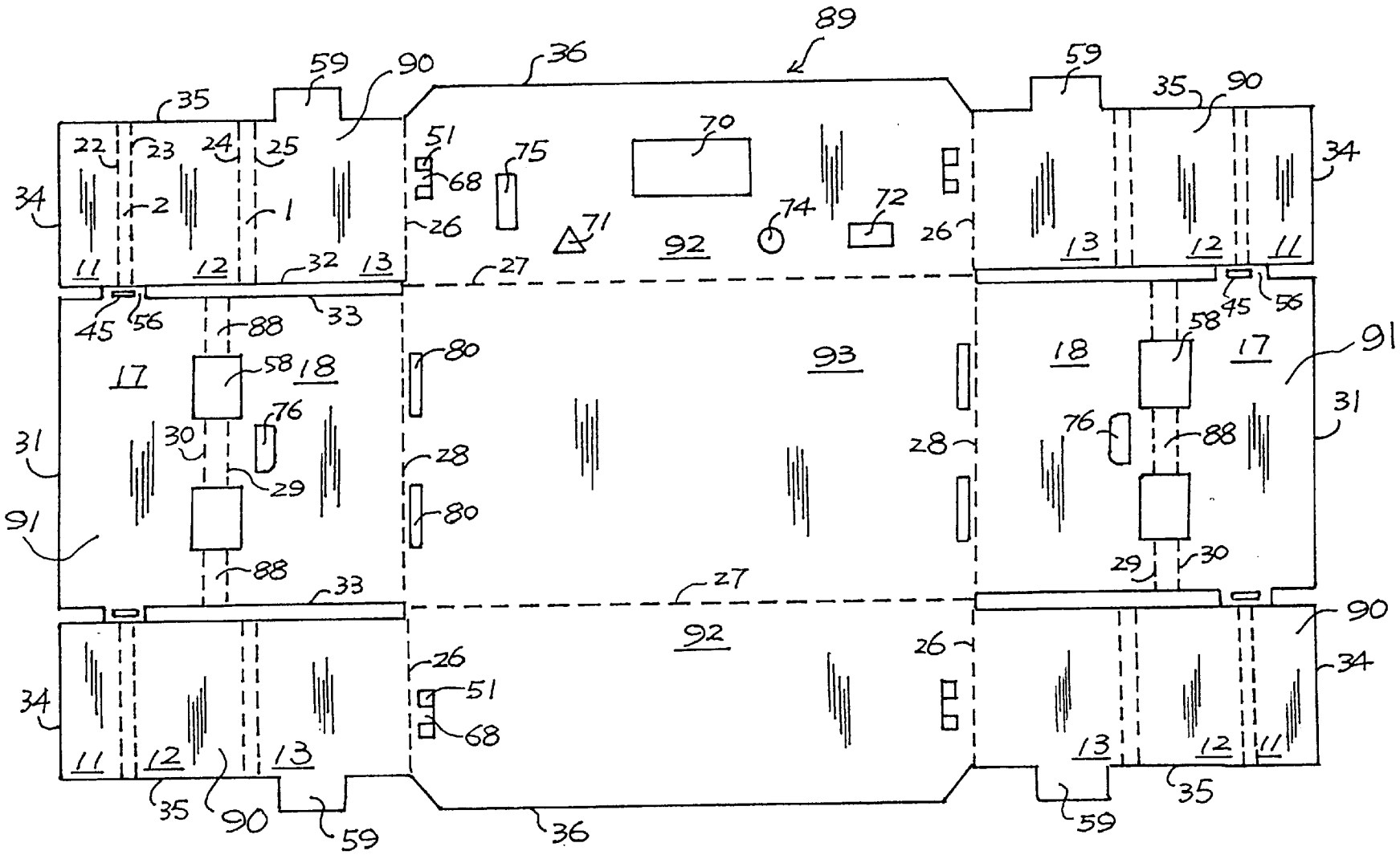
FIG. 2 is a plane view of the foldable tote box board of the present invention.
Figure 8:
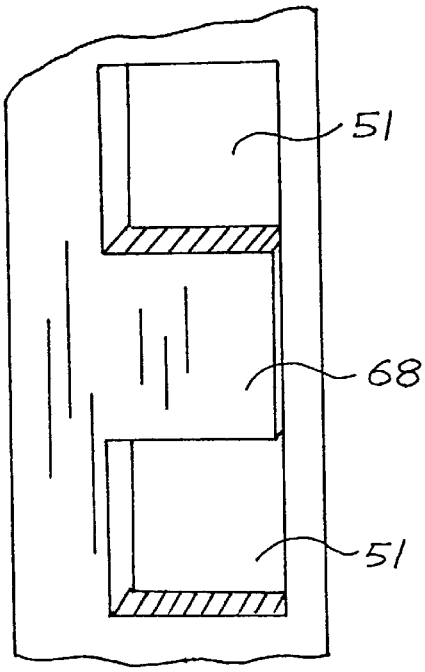
FIGS. 7–9 and 9A are perspective views showing a novel self-locking system of the present invention for use in boxes.
Figure 7:
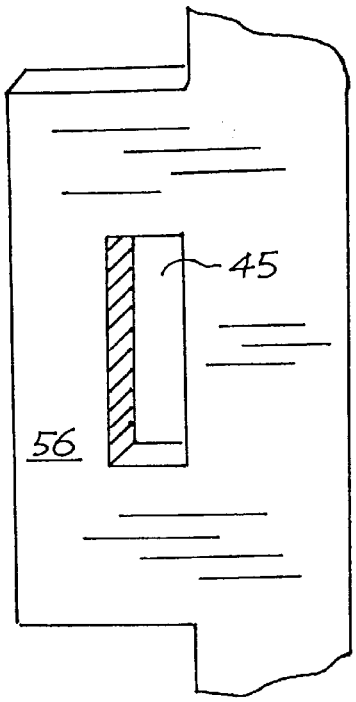

The tote box 89 of the present invention is constructed by a one-piece die-cut and scored board of corrugated materials, preferably corrugated plastic materials as shown in FIG. 2. The one-piece board of the box 89 comprises a bottom panel 93, two sidewall panels 92, two end wall panels 91, and four filler beam panels 90.

The die-cut and scored board of the tote box of the present invention is manufactured by die-cutting a piece of corrugated plastic board, that has smooth surfaces on both sides to obtain, at the predetermined locations, the stacking tabs 59, notch openings 58, stacking holes 80, sidewall top protrusions 36, locking pieces 56 and holes 45, and latch openings 51 and tongues 68. There are also die-cuts for handle-receptacles and venting apertures, if needed. At the time of die-cutting, the board is being scored to form folding lines at the predetermined locations on the board. The locations of the openings, holes, apertures, tabs, cuts and scored lines are respectively shown in FIG. 2. The scoring lines can also be formed in advance of or subsequently to the die-cutting.

The bottom panel 93 is defined by two scored folding lines 27 on side edges and two scored folding lines 28 on end edges. Four stacking holes 80 are formed, respectively, adjacent to the end folding lines 28. When the tote boxes are stacked up, the stacking holes 80 will, respectively, engage or receive the stacking tabs 59. The stacking holes 80 also provide outlets for water or any fluid that may be contained in the box or generated from the goods in the box. For instance, water or ice may be used for fresh produce, such as vegetables or fruits. Seafood is always in accompanying with water. However, as stated above, the stacking holes 80 can be eliminated if the water outlets are not desired. Thus, the stacking tabs 59 can be tilted outwardly to hold the upper box from outside.

The sidewall panels 92 extend, respectively, outwardly from the side scored folding lines 27. Each sidewall panel 92 has, at its ends, two end scored folding lines 26 that generally define the height of the tote box 89, and a top protrusion 36 extending beyond the end scoring lines 26 to form the top edge of the box 89. The distance between the end scored folding lines 26 of the sidewall panel 92 is a little shorter than the length of the side scored folding lines 27 of the bottom panel 93 by about the thickness or twice of the thickness of the board. On the sidewall panel 92, two latch openings 51 with latch tongues 68 are formed, respectively, adjacent to the end scored folding lines 26, and several venting apertures 70, 71, 72, 73, 74, 75 may be formed, as needed. The shapes and locations of these venting apertures are determined in accordance with usage of the box. There may be no such apertures at all if the contents to be packed in the box do not require such apertures.

Each of the filler beam panels 90 extends from the end scored folding line 26 of the sidewall panel 92, and thus has a width approximately equal to the length of the end scored folding line 26 or may be less than the length of the end folding line 26 by the thickness of the board. The filler beam panel 90 is divided by double scoring lines 22, 23, 24, 25 into three sections 11, 12, 13. The interval 1 between the scoring lines 24 and 25 is larger than the interval 2 between the scoring lines 22 and 23. When the filler beam panel 90 is folded to form a support beam, the section 11 will be folded against the section 13 so as to form a hollow support beam between the section 13 and section 12 as shown in FIGS. 4, 5 and 6. The strips between the respective pair of scoring lines 22 and 23 as well as between lines 24 and 25 form parts of the support beam.

The end wall panel 91 extends from the end scored folding line 28 of the bottom panel 93. The end wall panel 91 has a width a little narrower than the length of the end scored folding line 28 of the bottom panel 93. The end wall panel 91 is divided by double scoring lines 29 and 30 into an end wall section 18 and a flap section 17. The interval between the scoring lines 29 an 30 defines the support surface 88. The support surface portion 88 between the scoring lines 29 and 30 may override on the top edge 35 of the support beam when the box is assembled. The flap section 17 of the end wall panel 91 will be folded into the box assembled to serve as part of the inner surface of the box. At appropriate locations along the respective side edges 33 of the flap section 17, there are formed two locking pieces 56 with locking holes 45. When the flap section 17 is folded over, the locking pieces 56 are inserted into the latch openings 51 on the both sidewall panels 92 and the latch tongues 68 are, respectively, received in the locking holes 45 so as to lock the assembled box 89 as shown in FIG. 1. The size of locking and latching members can be bigger as shown in FIG. 12.

Alternatively, the locking pieces may be formed at the free end of each flap section 17. The latch openings with tongues are in the bottom panel 93. This is not shown in the drawing. However, it can be well understood. Thus, the flap section 17 may be locked to the bottom panel of the box.

The handle-receptacle 76 is formed by die-cut. The handle-receptacle is located on the end wall section 18 of the end wall panel 91 at a position that will be between the support beams constructed by the folded filler beam panels 90 as seen in FIG. 5. Other end edges 31 of the end wall panels and end edges 34 of the filler beam panels can be seen in FIG. 2 and FIGS. 11 and 11A.

FIGS. 3–6 illustrate the box assembling process. The sidewall panels 92 do not show any venting apertures thereon for purpose of simple illustration. FIG. 3 is a perspective view of the unfolded box board. FIG. 4 shows the formation of the four support beams by folding the filler beam panels 90. It can be seen that the interval 2 is less than the interval 1 by about the thickness of the board. Therefore, each of the support beam has approximately a rectangular cross section.

FIG. 5 shows that the support beams are further folded to the upright position. So are the sidewall panels 92. Thus, the end wall panels 91 can be folded over to embrace the support beams between the end wall section 18 and the flap section 17 of the end wall panel 91. FIG. 5 and FIG. 6 show the alignment of the notch openings 58 with the stacking tabs 59 before the flap section 17 embraces the support beams and the locking and latching members 56 and 51 engage with one another.

FIG. 6 also shows that the flap section 17 can be brought directly to embrace the support beams without careful alignment of the notch openings 58 and the stacking tabs 59. This is important when a person is in a hurry to put the box together. The box of the present invention can always be accurately assembled without paying too much attention to the assembling details.

Figure 9:
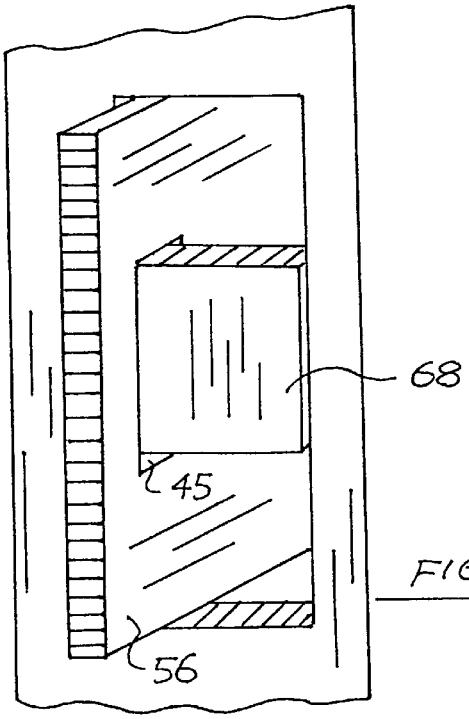
Figure 9A:
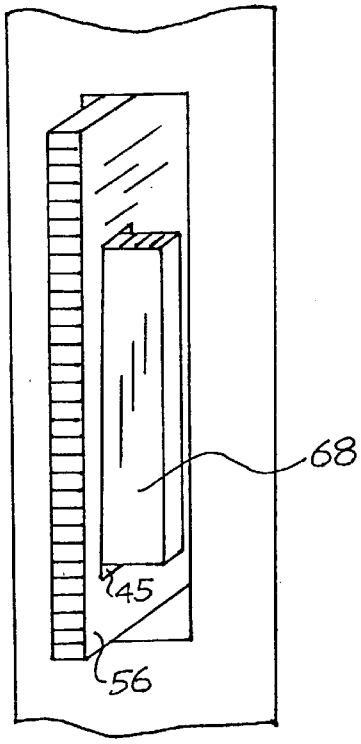

FIGS. 7–9 and 9A show the novel locking system of the present invention. The latch tongue 68 is about centrally located in the latch opening 51 (FIG. 8), which is provided on the sidewall panel 92 as described above. The locking hole 45 has a corresponding shape with the latch tongue 68, seen in FIGS. 7 and 8. Due to the semi-rigid but still flexible property of the corrugated plastic material and the orientation of the flutes 8 existing in the board, the locking piece 56 can be inserted into the latch opening 51 without any difficulty, while the latch tongue can be inserted into the locking hole 45 as well, shown in FIG. 9. FIG. 9A shows a bigger size of locking piece and hole and latch opening and tongue. Therefore, the formed locking system is very strong such that the flap section 17 can always hold the support beams in the correct position, usually in an upright position and can maintain the assembled box in a very good shape as seen in FIG. 1. On the other hand, the locking system can be easily released by hand. This locking system can be used in any box, not necessarily in boxes of plastic materials.

Also the one-piece board can be made of corrugated cardboard or any material other than plastics. Although the corrugated plastic boards are preferred, as described above, the box of the present invention is very strongly locked upon assembly. The relatively wide support surfaces 88 and the support beams can provide very stable support for the staking-up boxes.

FIGS. 10 and 10A illustrate the stacking of the tote boxes of the present invention. As seen in dotted line in FIG. 10, each stacking tab 59 is received in the stacking hole 80, which cannot be clearly illustrated in FIG. 10 but in FIGS. 2 and 3. The bottom of the upper box rests on the support surface 88 in dotted lines in FIG. 10. The support surface 88 has a width, seen in FIG. 10, that is enough to provide a stable support to the upper box rested thereon. FIG. 10A shows an alternative engagement, that is, the stacking tabs 59 are at outside of the box ends.

The notch opening 58 is wider than the width of the support surface 88, i.e., the interval between two scoring lines 24 and 25 such that a notch can be formed on at least the end wall section 18 as seen in FIG. 10, that is between the bottom edge of the upper box and the top edge of the lower box. Such notches may assist the removal of the upper box from the lower box, i.e., disengaging the stacking tabs 59 of the lower box from the stacking holes 80 of the upper box. However, the notch opening 58 does not have to be wider than the width of the support surface 88. The disengagement of the stacking tab 59 and the stacking hole 80 can be assisted by the handle receptacle 76. Therefore, the size of the notch opening 58 may be just big enough to let the stacking tab 59 pass through.

As seen in FIG. 10, the upright protrusions of the sidewall panel 92 can also provide certain assistance for restraining the movement of the boxes. Therefore, the tote boxes of the present invention can be stacked up very high, but still stand very steady even there is only a single pile of boxes. In contrary, the conventional boxes may be stacked up high by several piles such that the piles of the stacking boxes may lean one against another to stand more steady. The single pile of boxes may be more desirable than the multiple piles of boxes if the ground space is limited.

The primary structure of the box of the present invention has been described above. The box of the present invention has superior properties over the conventional boxes in terms of stable support. The one-piece board enables the easy storage of the board before the boxes are assembled for use. The durability of the corrugated plastic material gives the box of this invention the properties of moisture resistant or moisture free, washable, repeatedly reusable, and capability of undertaking heavy load. The box of this invention can be used not only outdoor in raining or snowing days, but also in cold storage or refrigerated transportation of goods, especially the fresh produce, meat or seafood so as to preserve the quality of the fresh produce.

Further, the strong plastic material and the strong support beams of the box can protect the fresh produce in the box from being squeezed by outside force or by top stacking weight. Particularly, the conventional boxes, even if they have filler layers on the side of the box, cannot provide strong support to the stacked-up and fully packed boxes during the wet weather conditions or under the sunshine or hot weather conditions. The filler layers of the conventional boxes will usually be softened in such situation. The support beams of the present invention, however, can still provide strong support to the fully packed and stacked-up boxes in these severe conditions. The beams of the present box are hollow inside such that the direct sunshine may soften the outer end wall section 18, but will not soften the support beam because the space inside beam and the flutes 8 in the board will provide much better venting effect to prevent the support beam from being softened by the sunshine heat.

Although there is no separate cover illustrated for use on the box of the present invention, it can be understood that any suitable cover may be used. Preferably, it is a cover that has openings or space for passing the tabs and may rest on the support surfaces 88.

Figures 11, 11A:
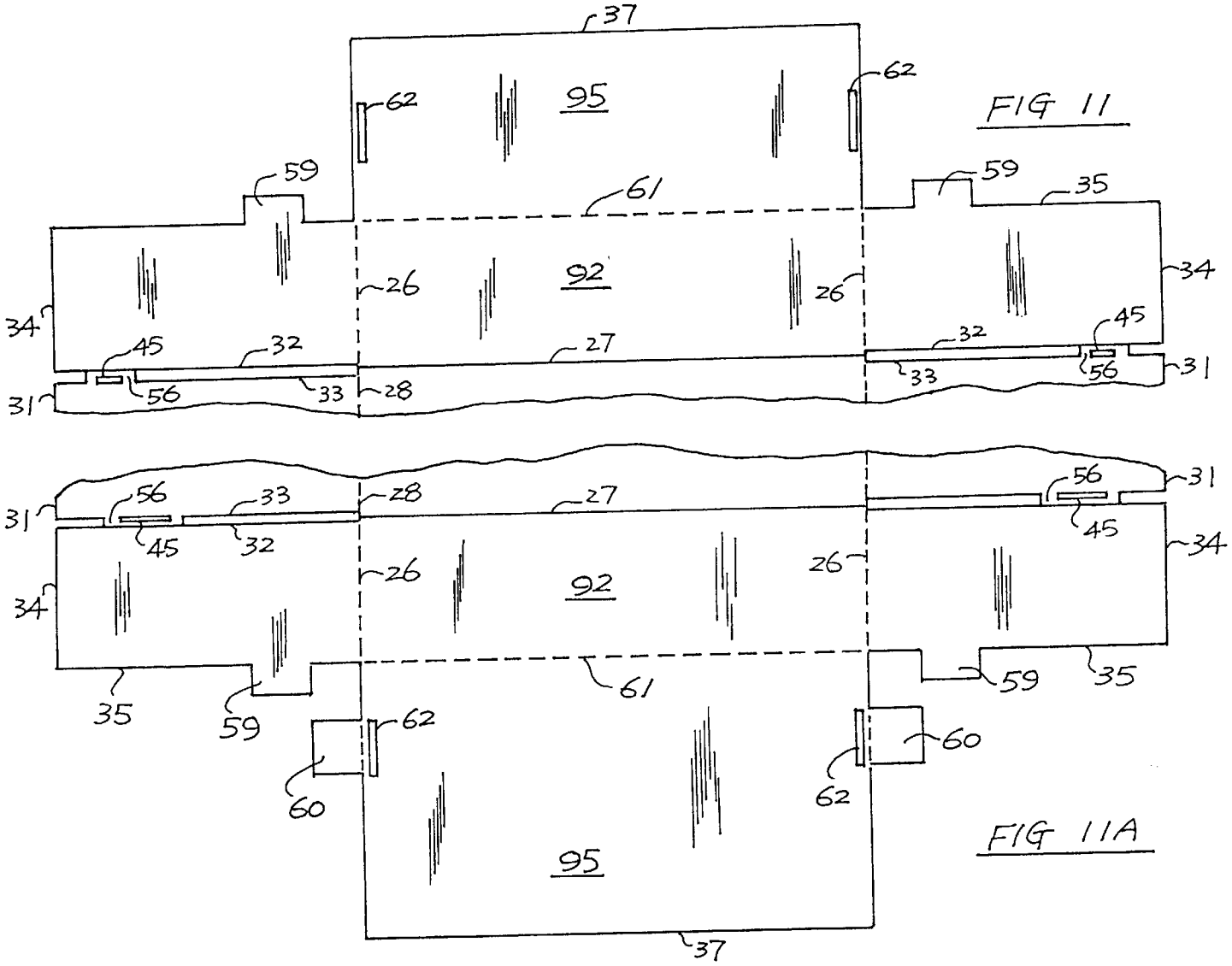
FIGS. 11 and 11A show respectively a plane view of partial tote box board of the present invention with an integral cover or cover panels.

Nonetheless, the box of the present invention may also include an integral cover that is formed as part of the one-piece board as shown in FIGS. 11–12. FIGS. 11 and 11A show the respective cover panels 95 that integrally connected to and outwardly extended from the top edges of the box along scored folding lines 61. The width of the cover panels depends on the size of the box such that when the box is assembled, the cover panels will close or almost close the top opening of the box depending on the specific requirements. The cover can be only one panel formed on one of the sidewall panel 92 of the box 89. There may be fastening tabs 60 and receiving apertures 62 formed at each side of the cover panel 95. When the box is closed, the receiving apertures 62 will let the stacking tabs 59 pass through and the fastening tabs 60 may be inserted between the beams and the end wall section 18 so as to fasten the cover to the box as seen in FIG. 12. The cover panels rest on the support surfaces 88 of the box. Thus, the cover panels provide additional support to the boxes stacked on the top.

I claim:

1. A foldable tote box comprising a one-pierce die-cut board of corrugated material, said board including a rectangular bottom panel having a length and a width defined by two side edges and two end edges; a pair of sidewall panels, each having a folding edge integrally connected to one of the side edge, of the bottom panel along a first scored folding line, a top edge opposite to the folding edge, and a pair of end edges defining a width of the sidewall panel that defines a height of the box; two pairs of filler beam panels, each pair of said filler beam panels respectively integrally connected to and extended from said end edges of one of said pair of sidewall panels along second scored folding lines, each of said filler beam panels being folded to form a hollow support beam; a pair of end wall panels respectively integrally connected to and extended from the end edges of the bottom panel along third scored folding lines, each of said end wall panels including an end wall section and a flap section divided by double scoring lines, thereby defining a support surface between the double scoring lines; and integrally formed means for locking the flap sections to one of said bottom panel and sidewall panels such that the flap section of each end wall panel holds two support beams formed by said filler beam panels against the end wall section of the end wall panel, wherein said locking means comprises a pair of latch openings formed adjecent to said end edges of the side wall panel, each latch opening having a latch tongue formed therein; and a pair of locking holes formed in a pair of locking pieces extendings from side edges of each end wall panel at the flap section such that each locking hole engages each latch tongue on the sidewall panel to lock the assembled box.

2. The foldable box of claim 1, further comprising a longitudinal protrusion extended outwardly from the top edge of the sidewall panel opposite to the folding edge connected to the bottom panel.

3. The foldable box of claim 1, wherein handle-receptacles are, respectively, formed on the end wall section of the end wall panels.

4. The foldable box of claim 1, wherein each filler beam panels includes at least three sections proportionally divided by double scoring lines between adjacent sections such that each section forms part of the support beam when the filler beam panel is folded.

5. The foldable box of claim 1, wherein a tab is integrally formed at a top edge of each of the filler beam panels, and there are two notch openings at predetermined locations along the double scoring lines on the end wall panel so that each tab of the filler beam panel protrudes through each of said notch openings when the board is folded to form the box.

6. The foldable box of claim 5, wherein each of the notch openings along the double scoring lines on the end wall panel has a size wider than the width of the support surface between the double scoring lines.

7. The foldable box of claim 5, wherein each of the notch opening along the double scoring lines on the end wall panel has a size equal to the width of the support surface between the double scoring lines.

8. The foldable box of claim 5, wherein there are two stacking holes formed on each end edge of the bottom panel adjacent to the third folding lines, said stacking holes being capable of receiving, respectively, the stacking tabs on the support beams when the assembled boxes are stacked up one atop another.

9. The foldable box of claim 1, wherein the corrugated board is plastic board that has smooth surfaces on both sides, thereby defining therebetween a plurality of flutes such that the flutes in the beams are in an upright position when the box is assembled.

10. A one-piece board of a foldable tote box of corrugated material, said board comprising a rectangular bottom panel having a predetermined length and width defined by pairs of side and end edges; a pair of sidewall panels, each having a folding edge integrally connected to one of the side edges of the bottom panel along a first scored folding line, a top edge opposite to the folding edge, and a pair of end edges defining a predetermined height of the box; two pairs of filler beam panels, each pair of the filler beam panels respectively integrally connected to and extended from said end edges of one of said pair of sidewall panels along second scored folding lines, each of said filler beam panels being capable of folding into a hollow support beam; a pair of end wall panels respectively integrally connected to and extended from the end edges of the bottom panel along third scored folding lines, each of said end wall panels including an end wall section and a flap section divided by double scoring lines, thereby defining a support surface portion between the double scoring lines; and locking means being integrally formed with the flap section and engageable with one of the bottom panel and sidewall panels such that the flap section of each end wall panel can hold two support beams formed by said filler beam panels against the end well section of the end wall panel when the box is assembled, wherein said locking means comprises a pair of latch opening formed adjacent to said end edges of each side wall panel, and each latch opening having a latch tongue formed therein; and a pair of locking holes formed in a pair of lock pieces extended from side edges of each end wall panel such that each locking hole is engageable with each latch tongue on the sidewall panel to lock the box to be formed.

11. The board of claim 10, wherein a longitudinal protrusion extends outwardly along the top edge of each sidewall panel opposite to the folding edge.

12. The board of claim 1, wherein at least three sections are defined by double scoring lines between adjacent sections on each filler beam panel and a tab is integrally formed at a top edge of each filler beam panel and positioned at one of said three sections.

13. The board of claim 12, herein two notch openings are formed at predetermined locations along the double scoring lines on the end wall panel so that each tab of the filler beam panel can protrude through each of said notch openings when the board is folded to form the box.

14. The board of claim 10, wherein a pair of cover panels are respectively integrally connected to and extended from the top edge of the sidewall, panels to form cover portions of the box.

15. The board of claim 14, wherein a pair of fastening tabs with passing holes are formed respectively at ends of each cover panel to be engageable with the end wall panel to fasten the cover thereon.

* * * * *